US005775566A

United States Patent [19]

Kochs et al.

[11] Patent Number: 5,775,566

[45] Date of Patent: Jul. 7, 1998

[54] MACHINE FOR THE ATTACHMENT OF BUTTONS, RIVETS OR THE LIKE, PREFERABLY TO ARTICLES OF CLOTHING

[75] Inventors: Karl-Josef Kochs, Baesweiler; Paul Hagmann, Stolberg, both of Germany

[73] Assignee: William Prym GmbH & Co. KG, Stolberg, Germany

[21] Appl. No.: 617,924

[22] PCT Filed: Sep. 6, 1994

[86] PCT No.: PCT/EP94/02962

§ 371 Date: Mar. 18, 1996

§ 102(e) Date: Mar. 18, 1996

[87] PCT Pub. No.: WO95/08278

PCT Pub. Date: Mar. 30, 1995

[30] Foreign Application Priority Data

Sep. 18, 1993 [DE] Germany ..... 43 31 783.9

[51] Int. Cl.[6] ..... A41H 37/02

[52] U.S. Cl. ..... 227/18; 227/119; 227/153; 227/155

[58] Field of Search ..... 277/17, 18, 16, 277/119, 152, 153, 155, 68, 22; 29/432, 243.53

[56] References Cited

FOREIGN PATENT DOCUMENTS

| | | |
|---|---|---|
| 0516929 | 12/1992 | European Pat. Off. . |
| 328042 | 7/1919 | Germany . |
| 629118 | 6/1932 | Germany . |
| 2757908 | 6/1979 | Germany . |
| 4117767 | 12/1992 | Germany . |

*Primary Examiner*—Scott A. Smith
*Attorney, Agent, or Firm*—Martin A. Farber

[57] ABSTRACT

A machine for the attachment of buttons, rivets or the like, preferably to articles of clothing, which buttons, rivets or the like consist of an upper portion and a lower portion, a material held between an upper clamping jaw and a lower clamping jaw being punched by actuation of a ram, and, after movement of a slide having an upper tool and a lower tool, the button portions disposed therein being positively connected to one another by ram actuation by virtue of the upper and lower tools being brought towards one another. In order to be able to carry out the punching of the article of clothing which is necessary before the attachment of the object, using the same machine and without changing the position of the article of clothing, an attachment tool (36) at the end of the ram is disposed, in the hole punching disposition (FIG. 3), in coaxial alignment with a hole punching tool (26).

11 Claims, 13 Drawing Sheets

MACHINE FOR THE ATTACHMENT OF BUTTONS, RIVETS OR THE LIKE, PREFERABLY TO ARTICLES OF CLOTHING

FIELD AND BACKGROUND OF THE INVENTION

The invention relates to a machine for the attachment of buttons, rivets or the like, preferably to articles of clothing, which buttons, rivets of the like consist of an upper portion and a lower portion, material held between an upper clamping jaw and a lower clamping jaw being punched by actuation of a ram, and, after a movement of a slide having an upper tool and a lower tool, the button portions disposed therein being positively connected to one another by actuation of the ram by way of the upper tool and the lower tool being brought towards one another.

A machine of the kind under discussion is known from DE 41 17 767 A1, the carriage being formed in the shape of a U and having U-shaped arms extending horizontally. These latter serve to hold upper and lower tools located one after the other in a sequential manner, which tools are each pushed under the ram according to the operation to be carried out. Three tools located one after the other are provided, the central tool serving for punching the article of clothing. There then takes place a displacement of the slide in the one or the other direction, so that the corresponding upper tool thereby reaches an aligned disposition opposite the ram.

SUMMARY OF THE INVENTION

It is an object of the invention to simplify the construction of a machine of the foregoing kind, in particular in the region of the tools.

This object is met by an attachment tool at the ram end being disposed, in a hole punching disposition, in coaxial disposition relative to a hole punching tool.

As a result of an arrangement of this kind, the construction of a machine of the present kind is simplified, along with reduced manufacturing costs. The attachment tool at the ram end and the hole punching tool are in coaxial alignment with one another in the hole punching disposition. There results from this a saving of space, which facilitates a tighter construction of the machine in the tool region. Only after punching of the material held between the clamping jaws, does the hole punching tool leave its disposition in which it is coaxial with the attachment tool at the ram end, and this is achieved by displacement of the slide. The attachment tool at the ram end can then extend between two tong jaws holding a button portion. These jaws are spread apart from one another during the downward travel of the ram by the attachment tool at the ram end, with release of the button portion, following on which the attachment tool travels into the position for connecting the button portions to one another. It is therefore only necessary to displace a relatively small mass, so that with simultaneous pre-punching of the article of clothing, approximately 160 attachment operations per minute may be carried out. After an attachment operation, the slide then returns back again into the position in which the attachment tool at the ram end is aligned with the hole punching tool. A new working cycle may then begin.

It has been found constructionally advantageous to provide a shoulder projecting from the ram, which, during hole punching, impacts against an opposing or counter shoulder of the one punch tool of the two punch tools working in opposition to one other. During the downward displacement of the ram, the shoulder of this ram brings along with it therefore, the punch tool associated with the ram by way of the counter shoulder. This takes place in the hole punching phase. When this is ended, the slide begins its displacement, by which the counter shoulder reaches a position away from the region of the shoulder of the ram.

For a trouble-free working run, there contributes the fact that the vertical displacement of one and/or both oppositely located tools is achieved by ram actuation and/or by a horizontal movement of the tool slide. When the counter shoulder leaves the region of the shoulder of the ram by virtue of slide movement, the horizontal movement of the tool slide is used in order to effect a fixed vertical displacement of a tool.

In advantageous manner, it is provided for this that during the horizontal displacement of the tool slide, a control flank of a tool carrier underruns an arm or bracket of the relevant clamping jaw which defines a finger protection cage. By this, the control of the tool carrier is thus achieved, when bringing the carrier along is no longer effected by the ram.

It is further provided that the tool carrier is spring-loaded against the slide, opposite to its working direction. After release of the control flank, the spring biassing is effective so that the tool carrier may always move back into its prescribed position.

In order to keep down friction during a cycle of operation, a roller impacting against the control flank of the tool carrier is associated with the finger protection cage, roller and control flank being out of engagement in the punching disposition. The movement towards one another of roller and control flank is achieved only when the slide is displaced.

It is therefore provided that the tool carrier, as upper tool, forms both the anvil for the punch tool and also a retaining tongs for the button upper portion. Anvil and retaining tongs are thus disposed behind one another in the direction of displacement of the slide and move alternately into the operating region of the ram.

Finally, a further advantageous feature consists in the upper tool and the lower tool being displaceable towards one another for the punching and/or the attachment. The significant work during punching and connecting is then carried out by the lower tool.

BRIEF DESCRIPTION OF THE DRAWINGS

With the above and other objects and advantages in view, the present invention will become more clearly understood in connection with the detailed description of the preferred embodiment, when considered with the accompanying drawings, of which, FIG. 7 is a representation corresponding to FIG. 6, the punching step being achieved by further drive action.

DETAILED DESCRIPTION OF THE PREFERRED EMBODIMENT

Figure 1:
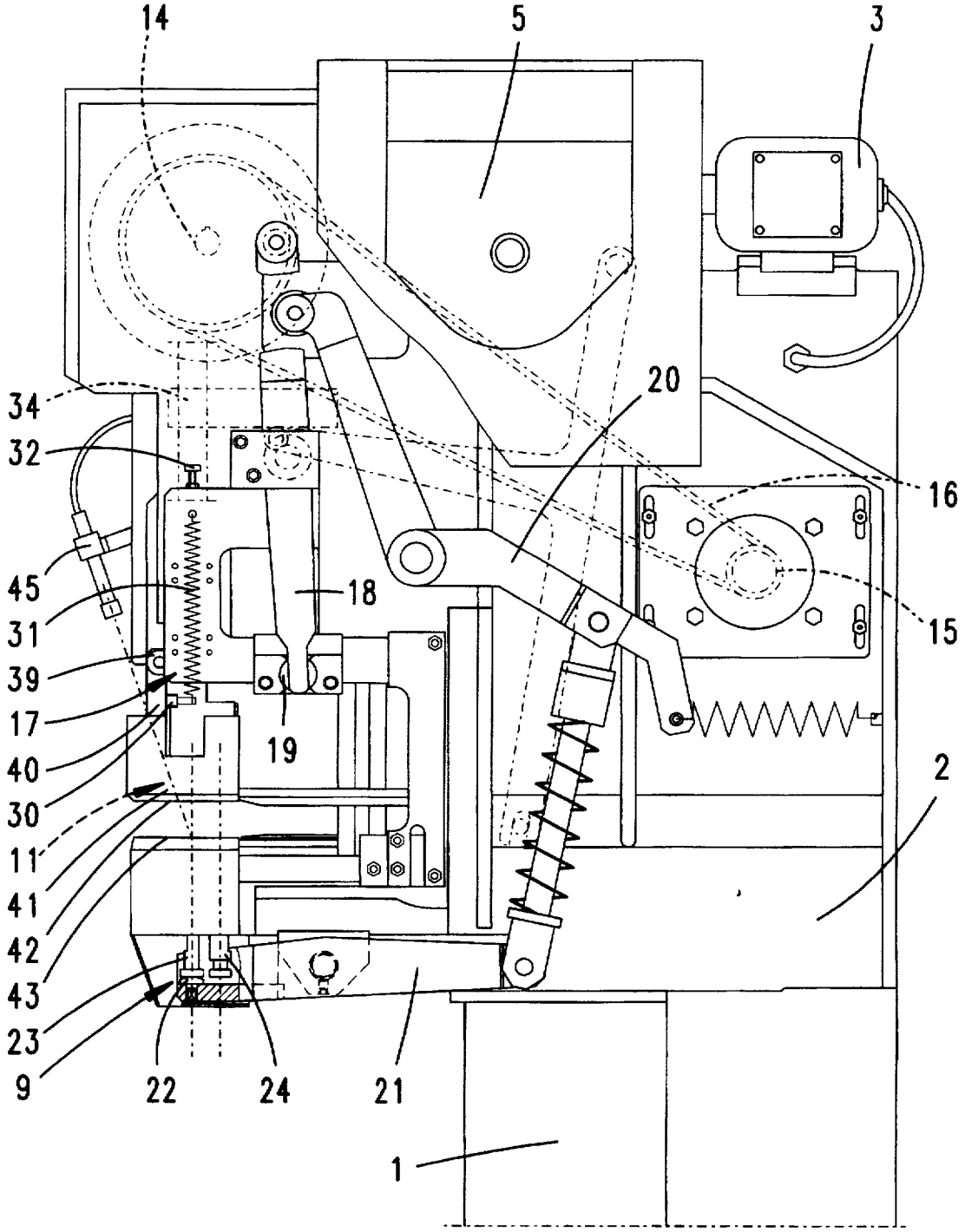
FIG. 1 shows a side view of an attaching machine formed in accordance with the invention, the tools being located in the starting position.
Figure 2:
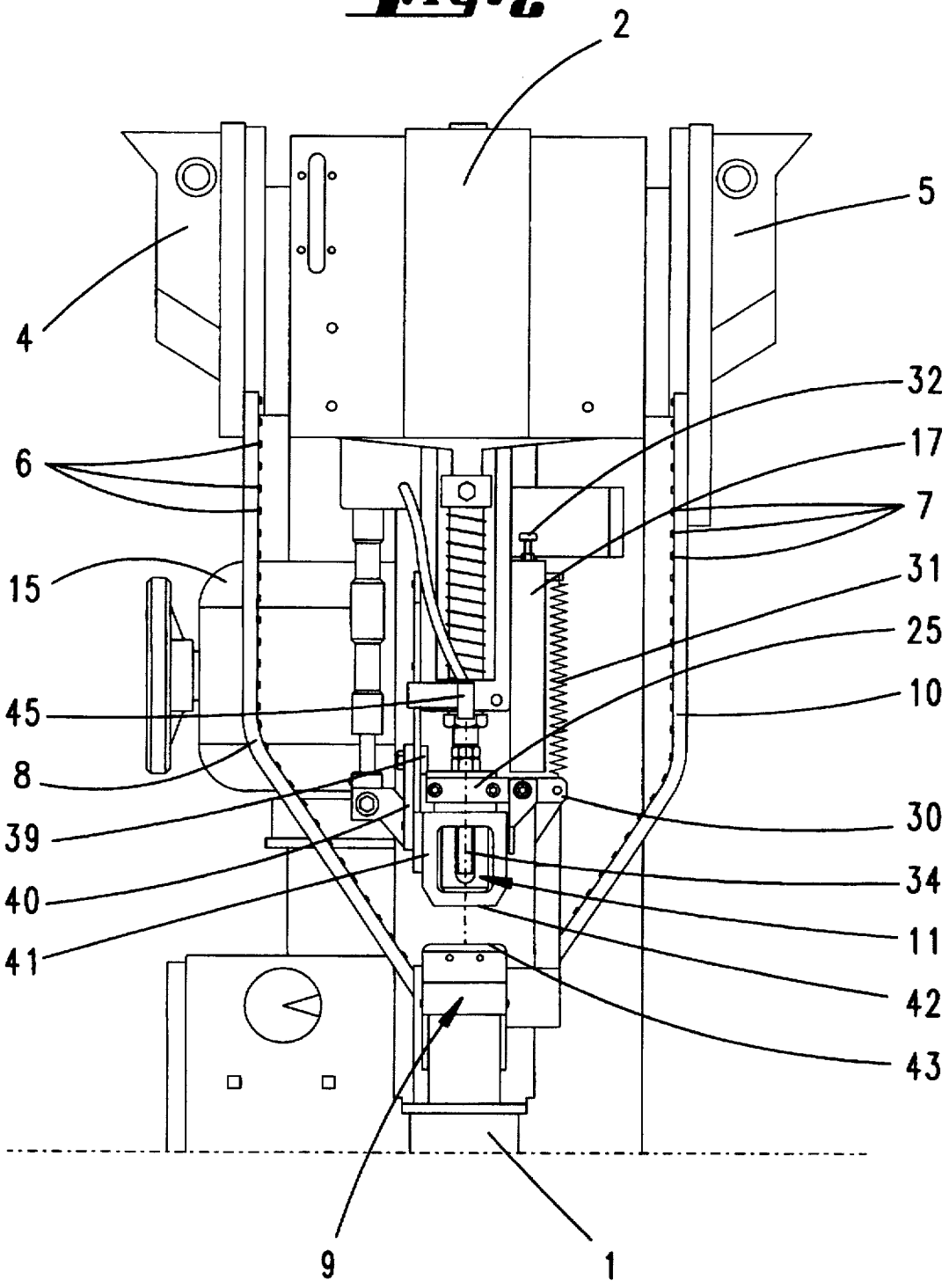
FIG. 2 is a front view of the machine.

The machine built according to the invention has a vertically arranged column 1, which for its part carries a machine head 2. In the upper region, the machine head 2 accommodates a drive motor 3 for turning magazine drums, not shown, of two magazines 4, 5 disposed to each side of the machine head 2. In the magazine 4, there are button lower portions 6 and in the magazine 5, button upper portions 7. The button lower portions 6 reach a lower tool 9 by way of a downwardly directed feed rail 8 and the button upper portions 7 reach an upper tool 11 by way of a feed rail 10. Horizontally displaceable pushers 12, 13 are provided, which effect the introduction of the button portions 6, 7 into the respective tools. The displacement of the pushers 12, 13 takes place in a cam-controlled manner by way of a cam plate, not shown, which for its part is mounted on a shaft 14 journalled in the upper region of the machine head 2. Drive of this shaft is effected by an electric motor 15, by way of a toothed belt 16 shown chain-dotted. The lower tool 9 and the upper tool 11 are carried by a slide 17 displaceable in the horizontal direction. Control of this is achieved by way of a lever 18 bearingly mounted on the machine head, the upper end of which engages a cam plate, not shown, also mounted on the shaft 14. The lower end of this lever 18 stands in engagement with a swivel joint 19 of the slide 17. When the shaft 14 and the associated cam plate, not shown, are driven, the double armed lever 18 pivots and thus carries the slide 17 with it in the horizontal direction.

A further cam plate mounted on the shaft 14, also not shown, drives a force transfer arm 21 formed in double-armed manner by way of a lever linkage 20. At its free end, this arm 21 carries pressure portion 22 for alternating actuation of a lower hole punching tool 23 and of a lower attachment tool 24, which extends parallel to the punching tool 23 and is vertically guided. These tools are guided in a lower horizontal arm 17' of the slide 17. The upper end face of the attachment tool 24 ends flush with the path of sliding of the pusher 13, so that this pusher is able to bring the button lower portion 6 to the attachment tool 24 in an aligned direction. The hole punching tool 23 located at the outer end of the arm 17' projects beyond this attachment tool 24, the end face of the hole punching tool 23 forming a cross-shaped cutter.

Figure 4:
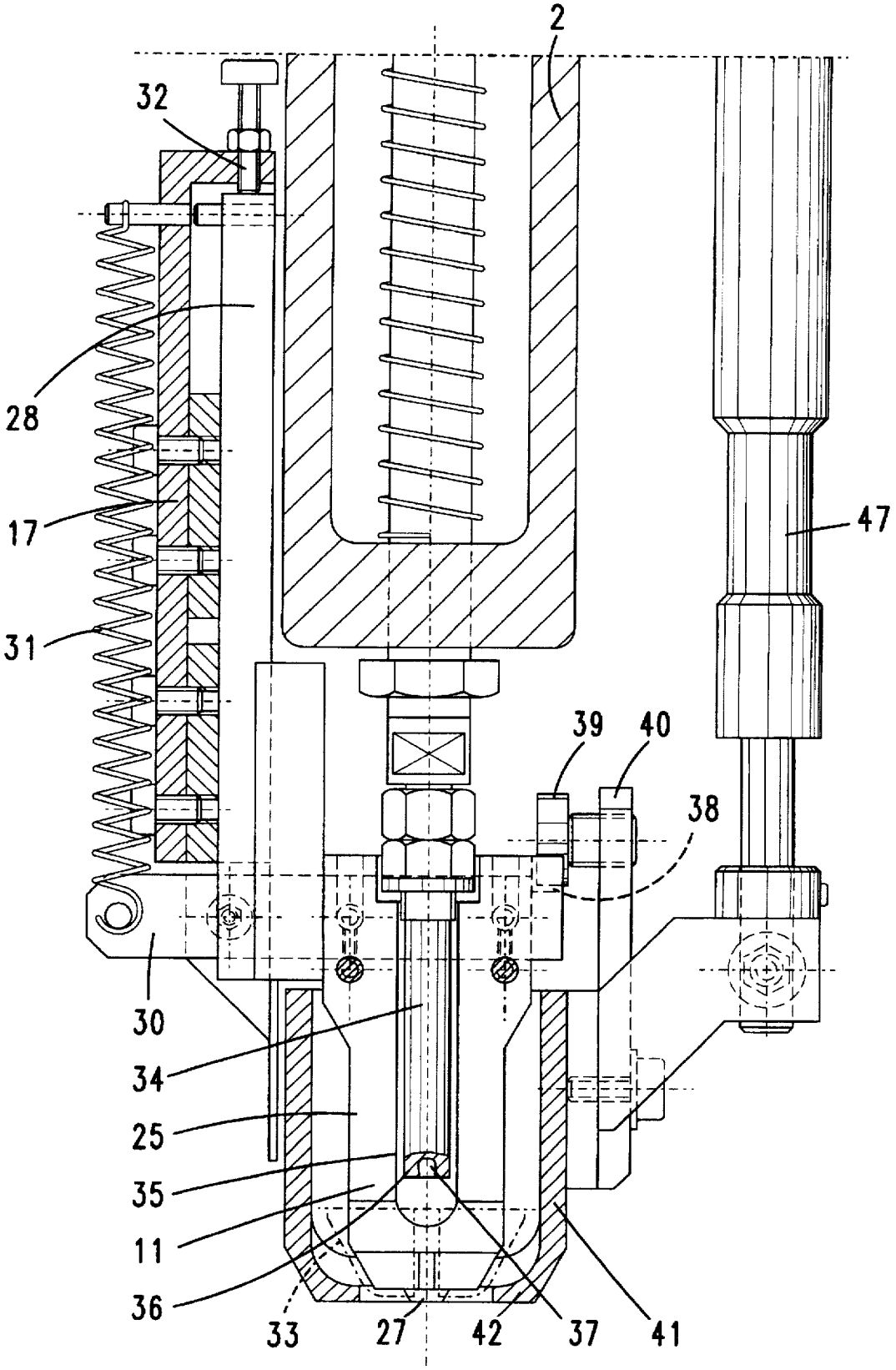
FIG. 4 shows a vertical section through the head of the machine in a view onto the front side of the machine.
Figure 5:
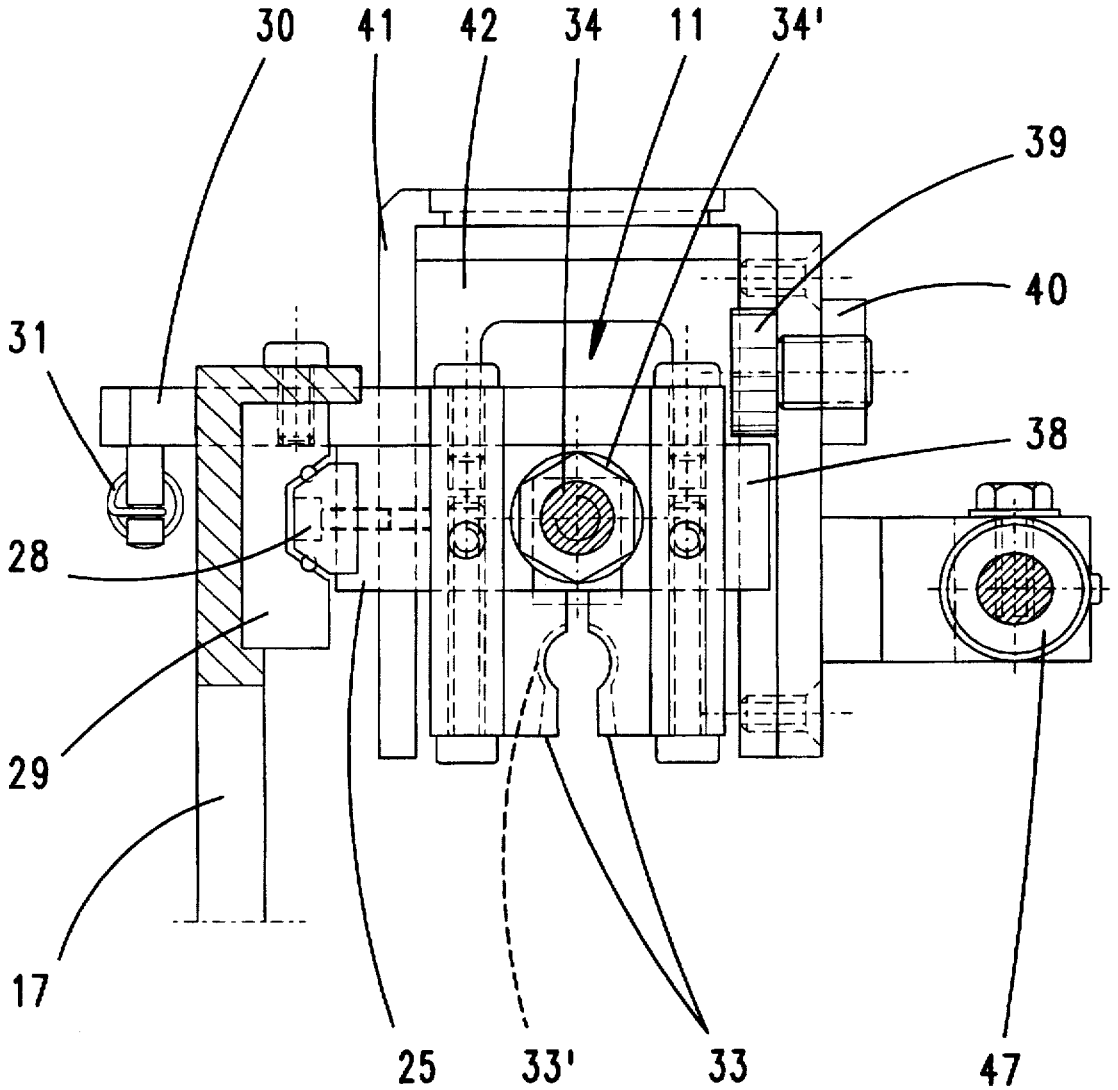
FIG. 5 is a horizontal section through FIG. 4, on a section plane above the tool carrier.

The upper tool 11 includes a tool carrier 25. This accommodates at its lower end, an upper pin-form punch tool 26, the lower end face of which forms the anvil 27 for the lower punch tool 23. In the starting position, the punch tools 23, 26 are located opposite one another, at a spacing from each other, and in alignment with one another. The tool carrier 25 is displaceable in the vertical direction by means of a guide rail 28 in a ball guide 29 on the inner side of the slide 17, see in particular FIGS. 4 and 5. On a transverse arm 30 of the tool carrier 25, there engages a tension spring 25 mounted on the slide 17, which urges the tool carrier 25 in the upward direction. The upward displacement is limited by an adjustable abutment screw 32 of the slide 17, against which abutment screw 32, there engages the end face of the guide rail 28 of the tool carrier 25, see FIG. 4. The abutment screw 32 has the effect that a receiving opening 33' of a retaining tongs 33 provided on the tool carrier 25 for the button upper portion 7 is so arranged that problem free pushing in of a button upper portion 7 by the upper pusher 12 is assured. The individually pivoted jaws of the retaining tongs 33 are spring-loaded in the closing direction in known manner.

In the starting position of the machine, a ram 34 is aligned with the upper punch tool 26. For control of this ram, there likewise serves a cam plate, not shown, disposed on the shaft 14. The ram 34 extends in this starting position in a channel 35 which is open towards the retaining tongs 33, the width of the channel corresponding also to the spacing of the tong jaws of the retaining tongs 33, so that a pre-displacement of the slide 17 with the tool carrier 25 may be effected. At its end, the ram 34 forms the upper attachment tool 36. It has a hole 37 for matching reception of the projecting portion of the button upper portion 7.

At the upper end, the tool carrier 25 is provided with a control flank 38 rising in a sloping manner in the direction of the retaining tongs 33. This flank cooperates with a roller 39, which for its part is disposed on a vertical arm 40 of a finger protection cage 41. In the punching position, the roller 39 and the control flank 38 are not in engagement. The finger protection cage 41 surrounds the lower end of the tool carrier 25 and its lower horizontal section 42 forms a clamping jaw. In order to control the finger protection cage 31, there serves a further cam plate located on the shaft 14, which cam plate is known so that there is no need to describe it further. The link between finger protection cage 41 and cam disc is formed by a telescopic rod guide 47 with the inclusion of a finger protection spring, not shown, which is dimensioned to be stronger than the force of the tension spring 31 urging the tool carrier 25 away from its working direction.

Figure 13:
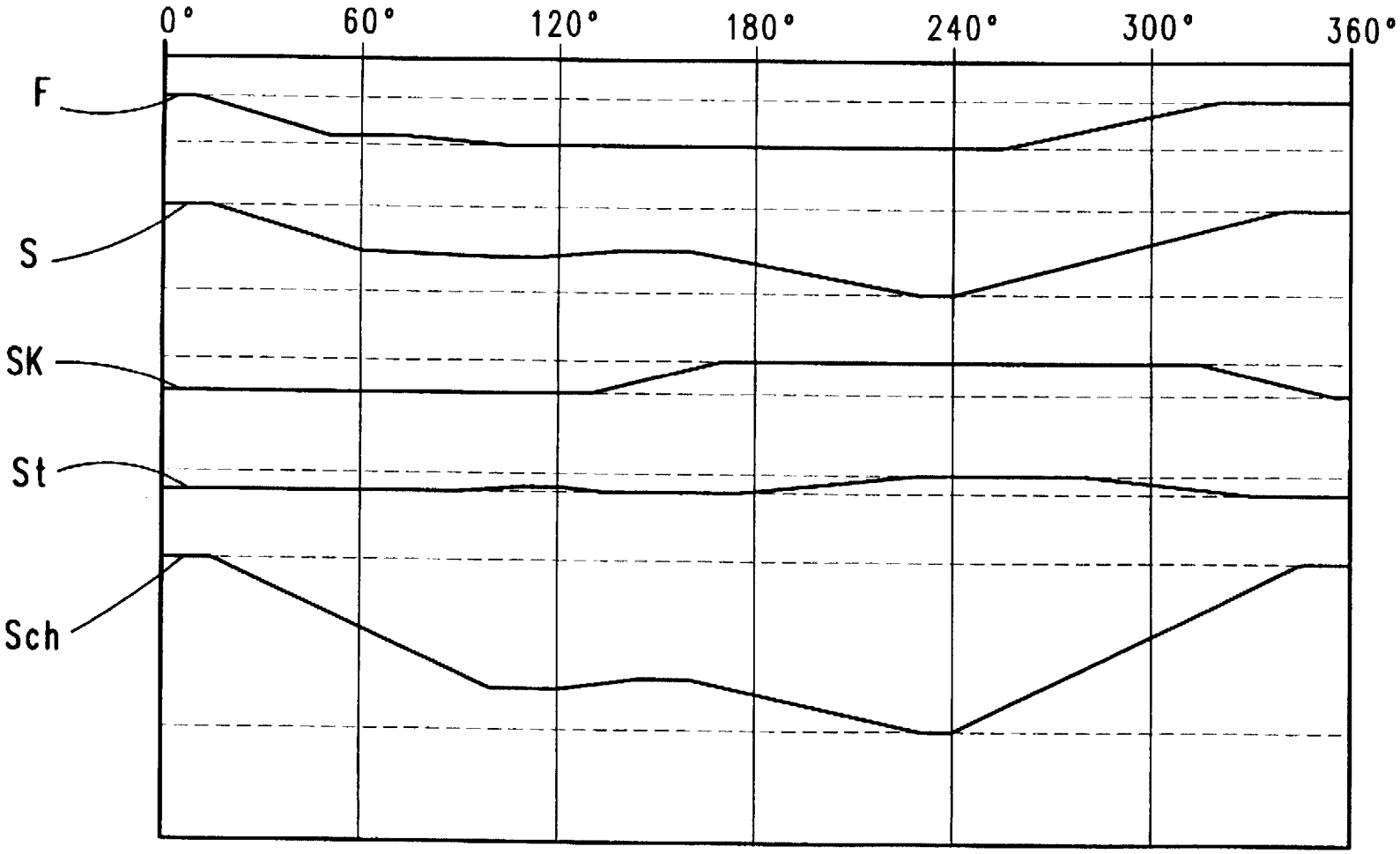
FIG. 13 is a diagram of the individually controlled components during a working cycle.

The following manner of working is applied:

In the starting position, which corresponds to the 0° position of the diagram in FIG. 13, the clamping jaw 42 of the finger protection cage 41 is located at a spacing from the lower horizontal support stage of the lower tool 9, which support stage forms the lower clamping jaw 43. In addition, the pushers 12, 13 take up their forward push-in position. The attachment tool 36, at the end of the ram, then extends in this hole punching position in coaxial alignment with the upper hole punching tool 26, so that the upper tool 11 provides two tools aligned axially with one another.

The article of clothing 44 to be furnished with the button portions 6, 7 is then laid on the lower clamping jaw 43. In order to assist alignment, there serves a projection lamp 45, which provides a cross hairs on the article of clothing 44.

Figure 6:
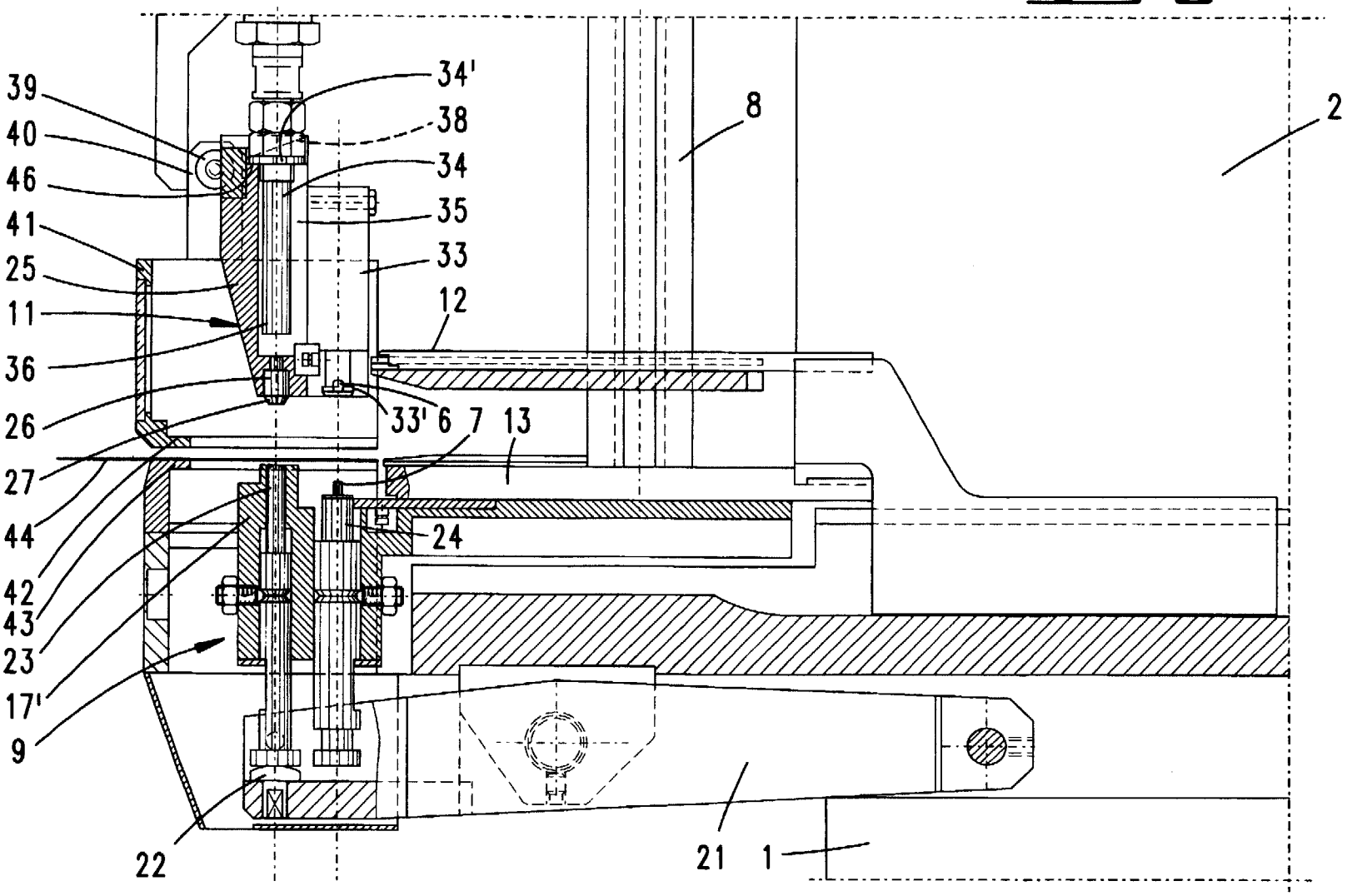
FIG. 6 shows the representation following on FIG. 3 with a finger protection cage moved somewhat towards a finger protecting spacing.
Figure 1:
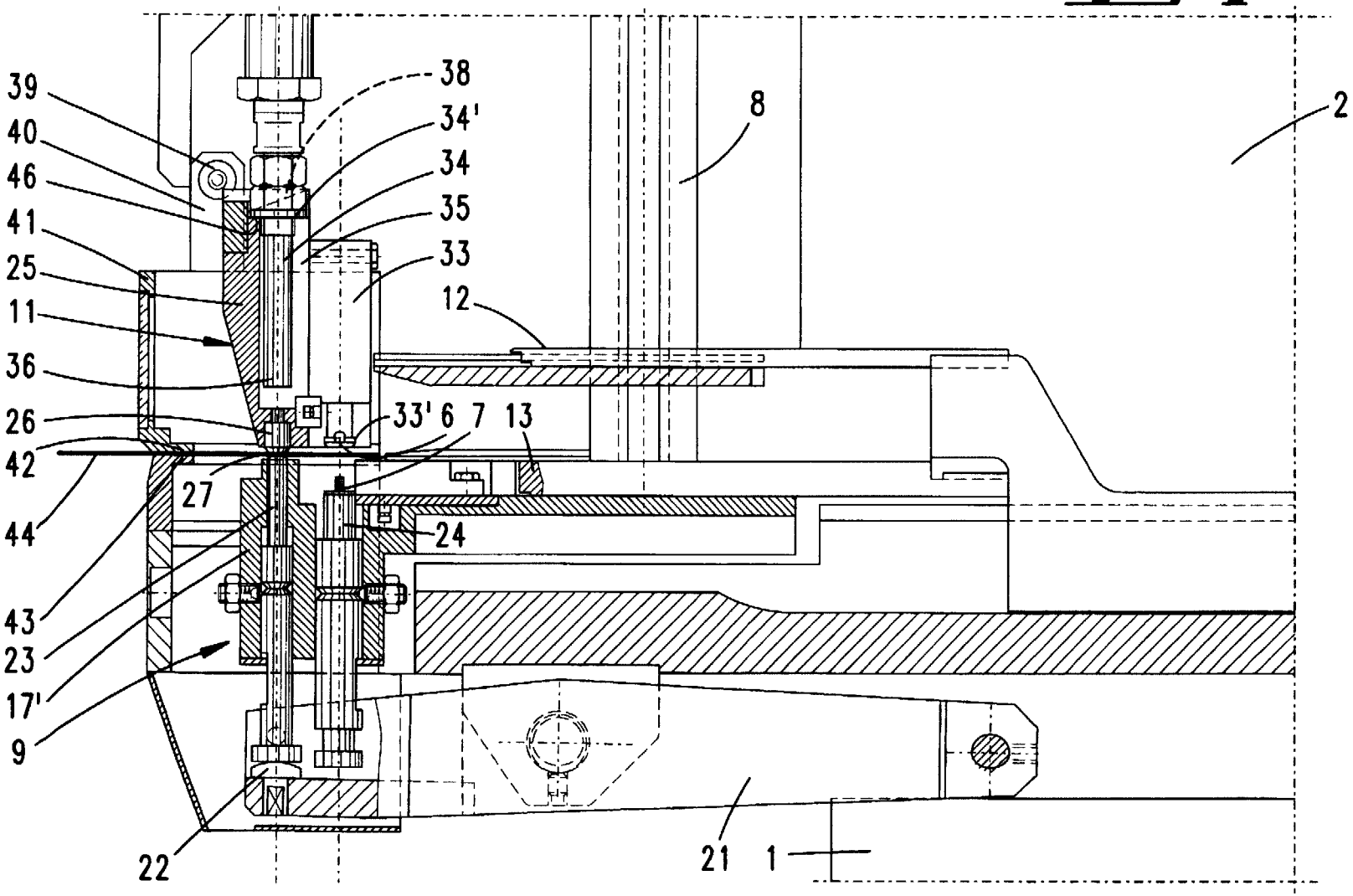

After actuation of a foot switch, not shown, the work cycle commences, and the shaft 14 is driven along with the cam plates mounted on it. By this, the finger protection cage 41 is brought to a finger protecting spacing of approximately 4 mm from the article of clothing 44. If the finger protection cage cannot traverse this path, a safety switch triggered by the finger protection cage 41 trips out the drive. The finger protecting position will be apparent from FIG. 6, which corresponds to rotation of the shaft 14 through approximately 50°. Along with the downward displacement of the finger protecting cage 41, the ram 34 has also moved in the downward direction by a small amount. A radially projecting shoulder 34' of the ram 34 thus impacts against an opposing or counter shoulder 46 of the tool carrier 25.

FIG. 7 corresponds approximately to a rotation of the shaft 14 through 110°. The clamping jaw 42 of the finger protection cage 41 engages against the article of clothing 44, which is held between the lower clamping jaw 43 and the upper clamping jaw 42 in an immovable manner. The ram 34 has also moved further in the downward direction and thus also the tool carrier 25, the hole punching tool 26 of which touches down on the upper surface of the article of clothing 44. Furthermore, the force transfer arm 21 is pivoted in the clockwise direction by means of the cam-controlled lever linkage 20, as a consequence of which the pressure portion 22 moves the lower hole punching tool 23 in the upward direction, the article of clothing 44 being prepunched at the relevant location by means of the cruciform cutter located on this lower tool. FIG. 7 also shows that the pushers 12, 13 are moved back.

Figure 8:
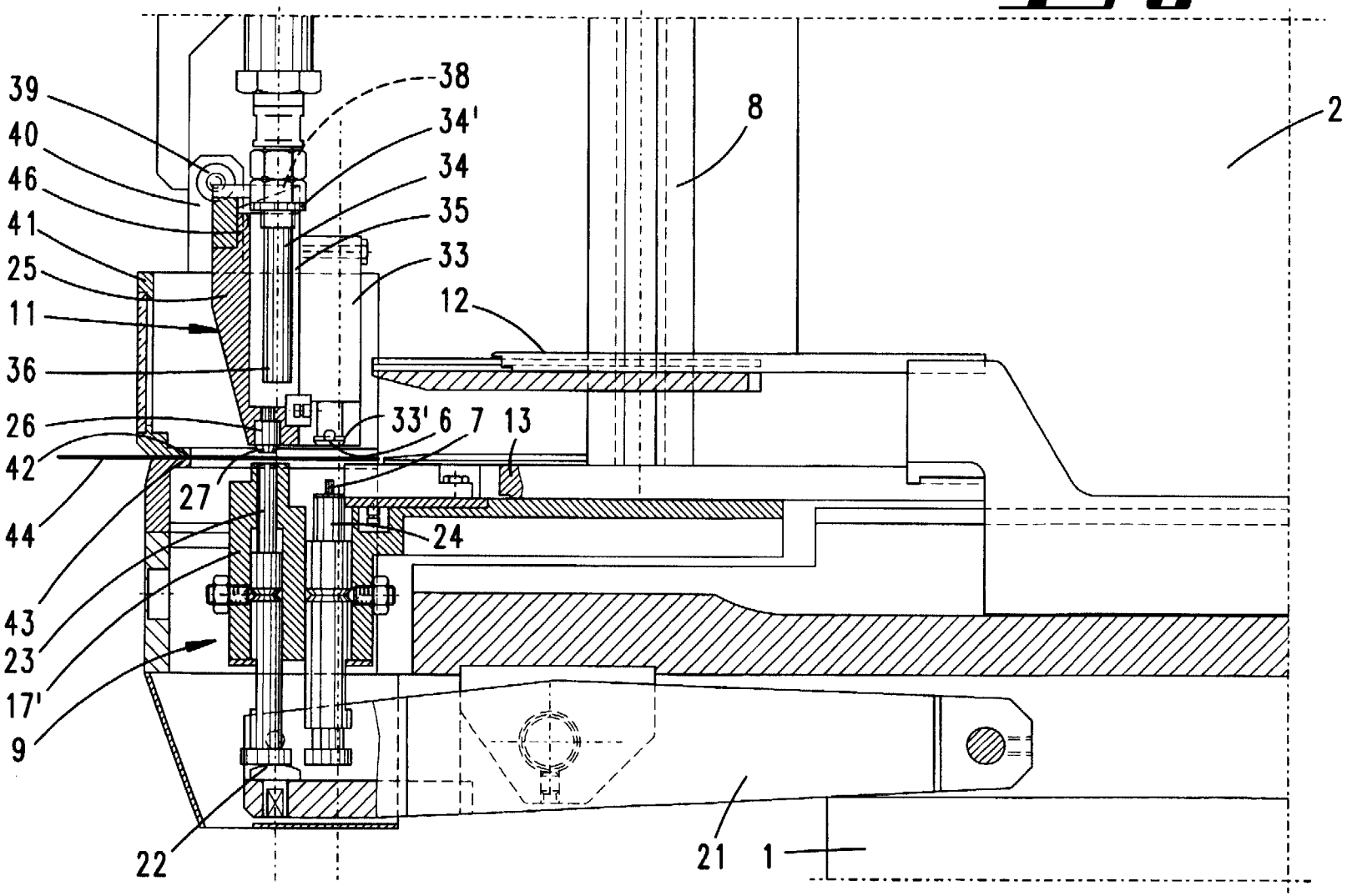
FIG. 8 shows the representation following on FIG. 7, for the tool carrier being slightly raised and inserting displacement of the tool slide.
Figure 9:
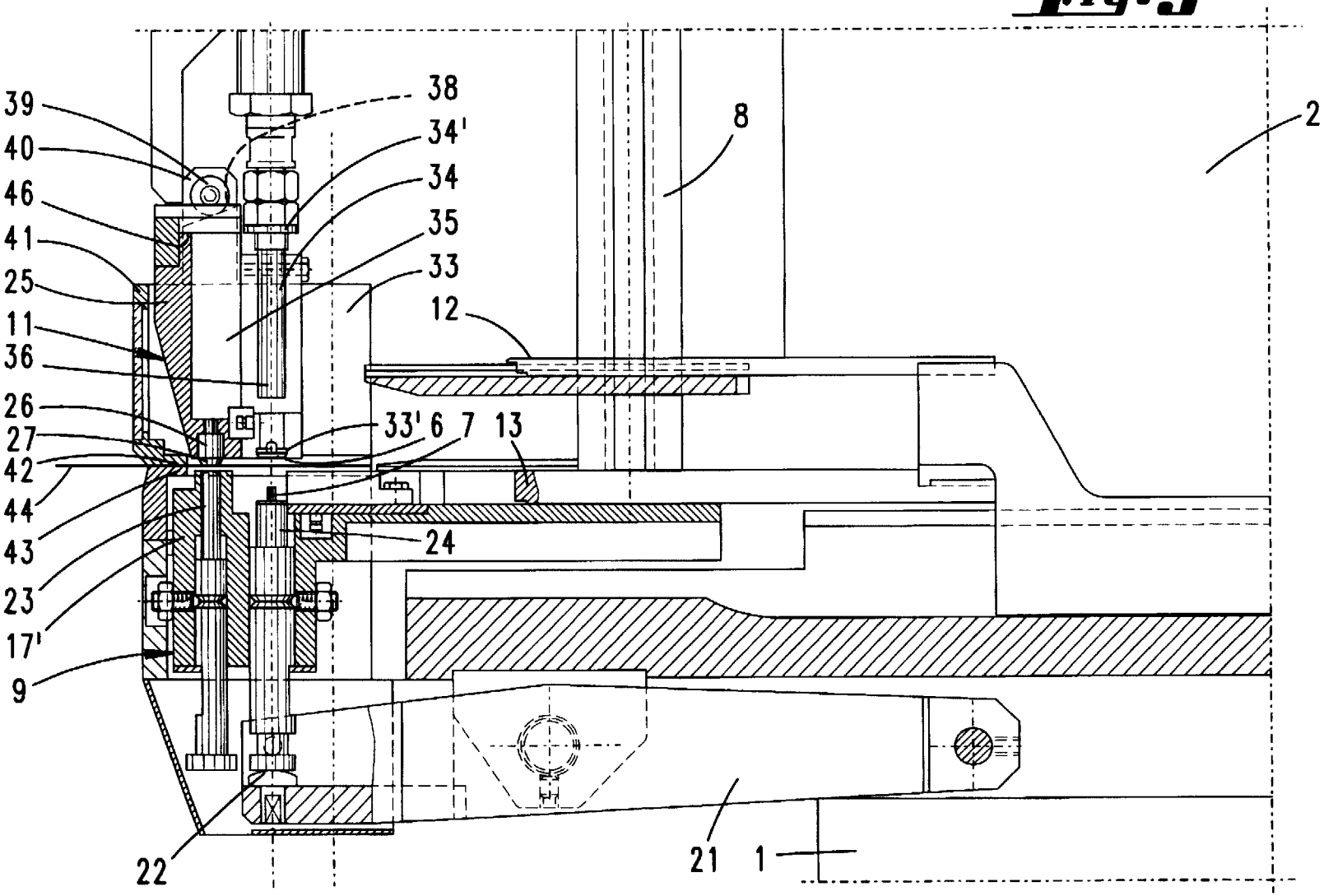
FIG. 9 is the representation following on FIG. 8, for the slide displacement having ended and the attachment tools being aligned with one another.

According to FIG. 8, the shaft has turned through about 140°. The punching stage is finished. The finger protection cage 41 continues in its lower position with clamping of the article of clothing 44. However, the ram 34 has moved a small distance upwards (in practice about 3 mm), and the tension spring 31 pulls the tool carrier 25 with it, whereby the hole punching tool 26 moves into a position at a small spacing from the article of clothing. Similarly, the hole punching tool 23 moves approximately 3 mm in the downward direction. Overlapping these movements, the slide 17 is pre-displaced under cam control. By this, the tool carrier 25 is carried along, so that the ram 34 leaves the channel 35 and enters between the tong jaws of the retaining tongs 33. There results from this the position according to FIG. 9, which corresponds to rotation of the shaft 14 through approximately 180°. Along with the horizontal pushing of the slide 17, the control flank 38 of the tool carrier 25 travels under the roller 39 disposed on the arm or bracket 40 of the finger protection cage 41, as a consequence of which there is a small downward displacement of the upper tool carrier 25, so that the retaining tongs 33 carrying the button upper portion 7 move into the neighbourhood of the upper side of the article of clothing 44.

Figure 10:
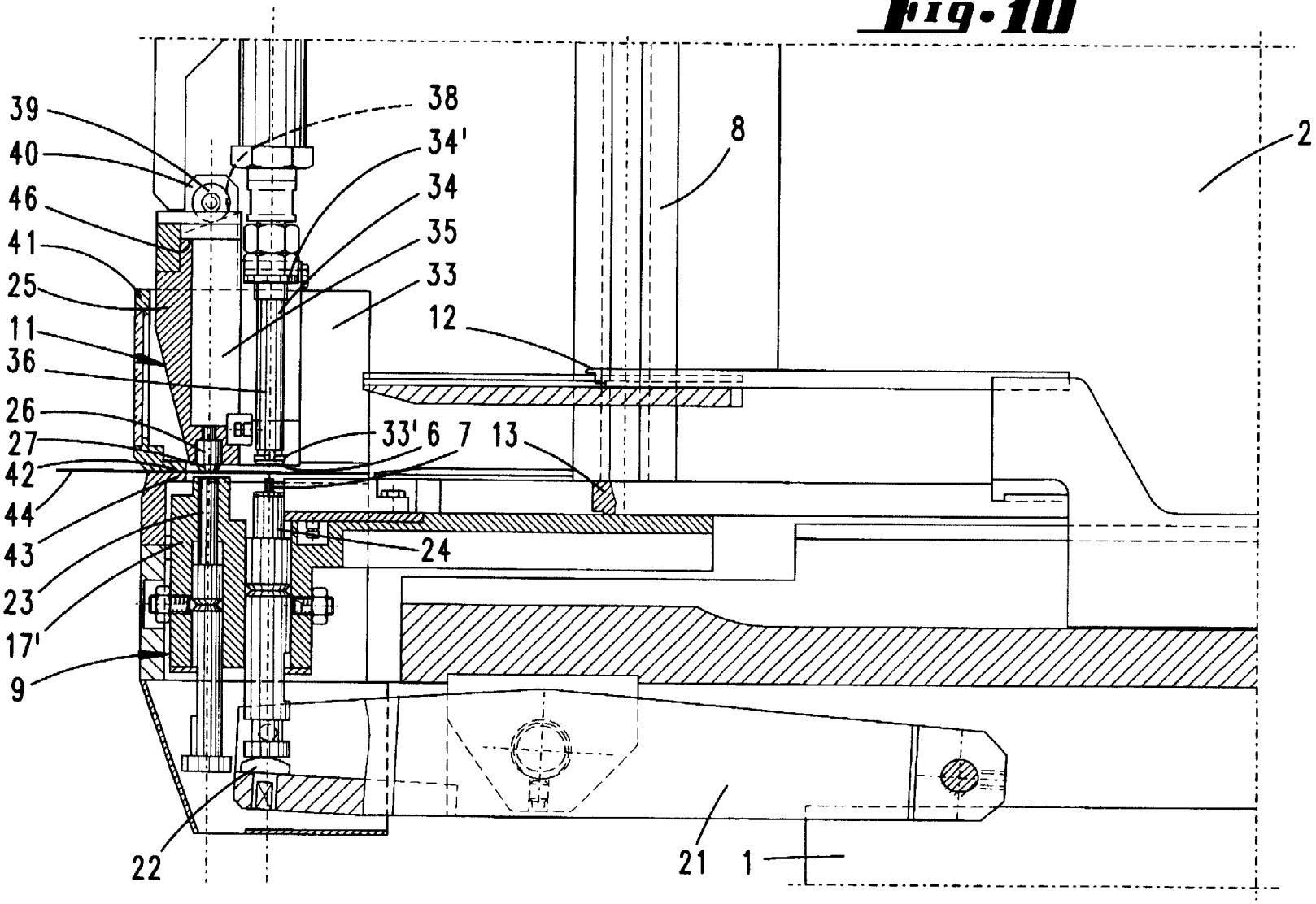
FIG. 10 is the representation following on FIG. 9 during the downward movement of the ram and the spreading apart from one another of the clamping jaws holding the button upper portion.
Figure 11:
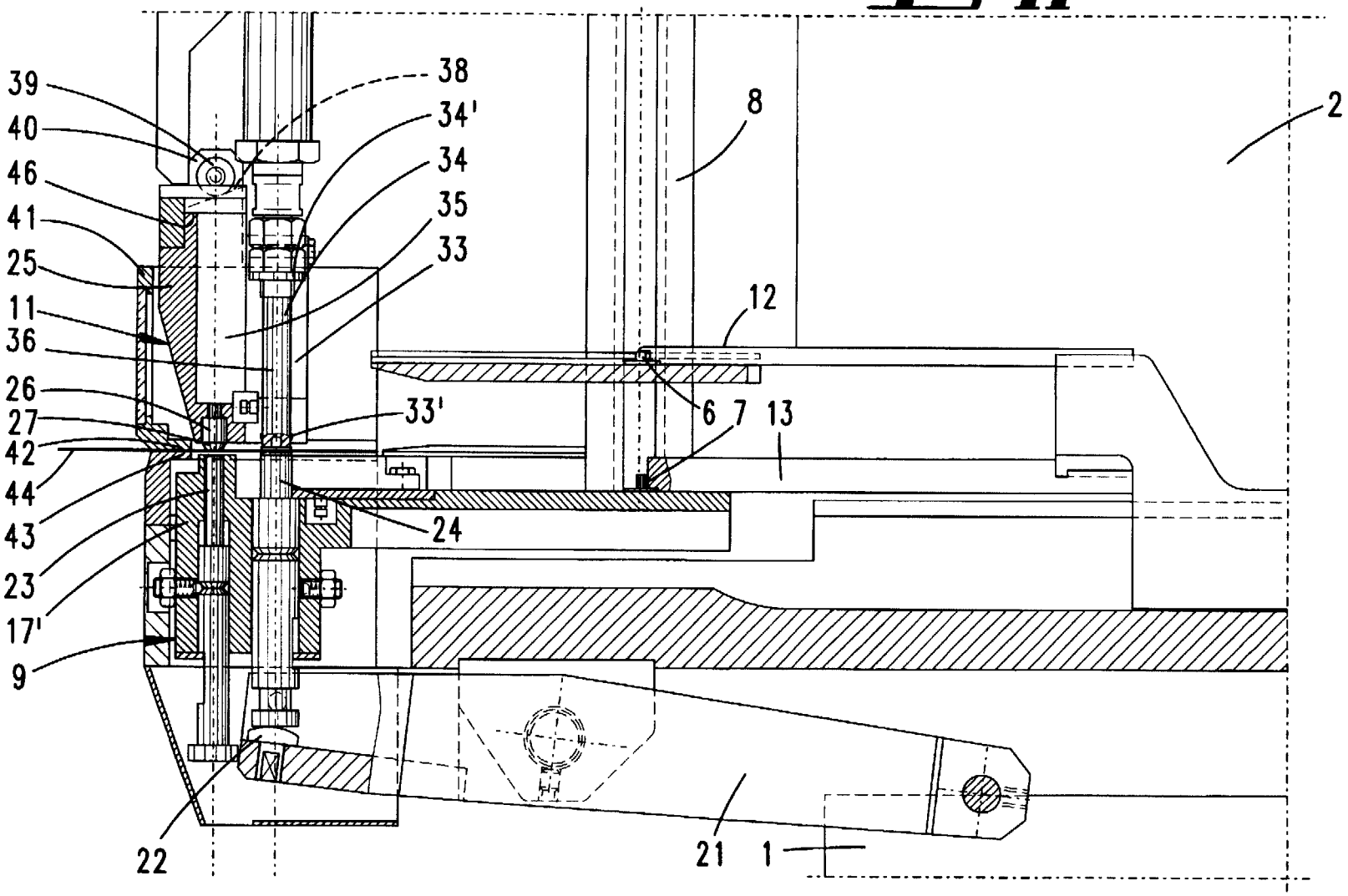
FIG. 11 is the representation following on FIG. 10, relating to the connecting step for the button portions.

Downward movement of the ram 34 now commences, see FIG. 10. This corresponds approximately to 205° rotation of the shaft 14. The force transfer arm 21 has also pivoted somewhat in the upward direction with corresponding displacement of the lower attachment tool 24. By means of the ram 34 and the attachment tool 36 provided at the end of the ram, the retaining tongs 33 is opened against spring loading, so that the connection of the button portions 6, 7 by travel towards one another of the attachment tools is achieved. The major work is carried out for this by the force transfer arm 21 impacting on the lower attachment tool 24. This corresponds approximately to 230° rotational displacement of the shaft 14. The ram 34 takes up its lowermost position. Further, the lower attachment tool 24 has travelled into its highest position. In this position, the pushers 12, 13 are in a fully backwardly displaced position and enable the introduction of the button portions 6, 7 delivered from the feed rails 8, 10. In this position according to FIG. 11, the engagement of the control flank 38 on the roller 39 prevents the tension spring 31 from moving the tool carrier 25 in the upward direction.

Figure 3:
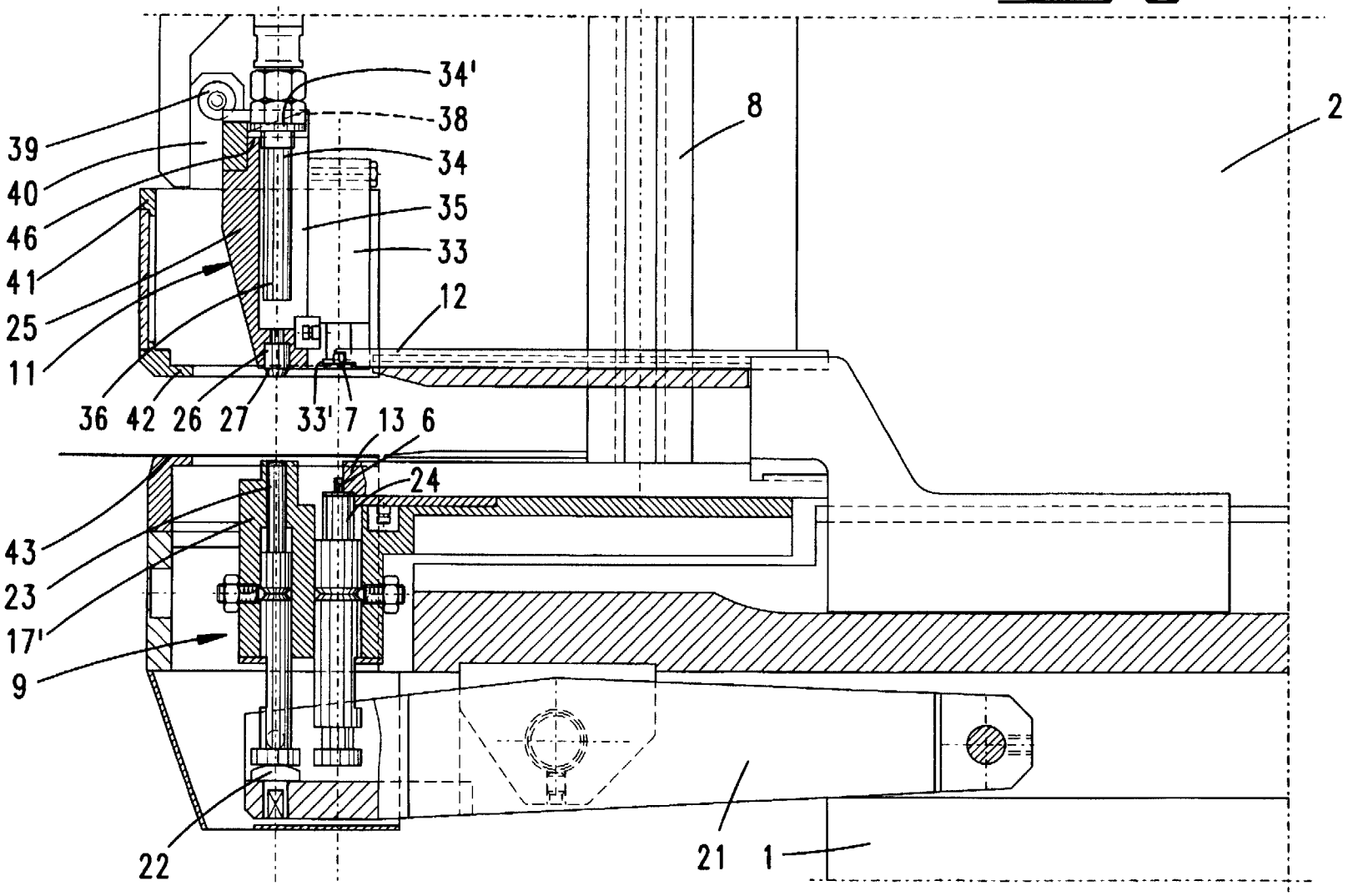
FIG. 3 is a vertical section through the machine in the plane of slide movement, relating to the starting position, thus with the ram in its uppermost position of travel and the force transfer lever for the lower tools located in the lower position.
Figure 12:
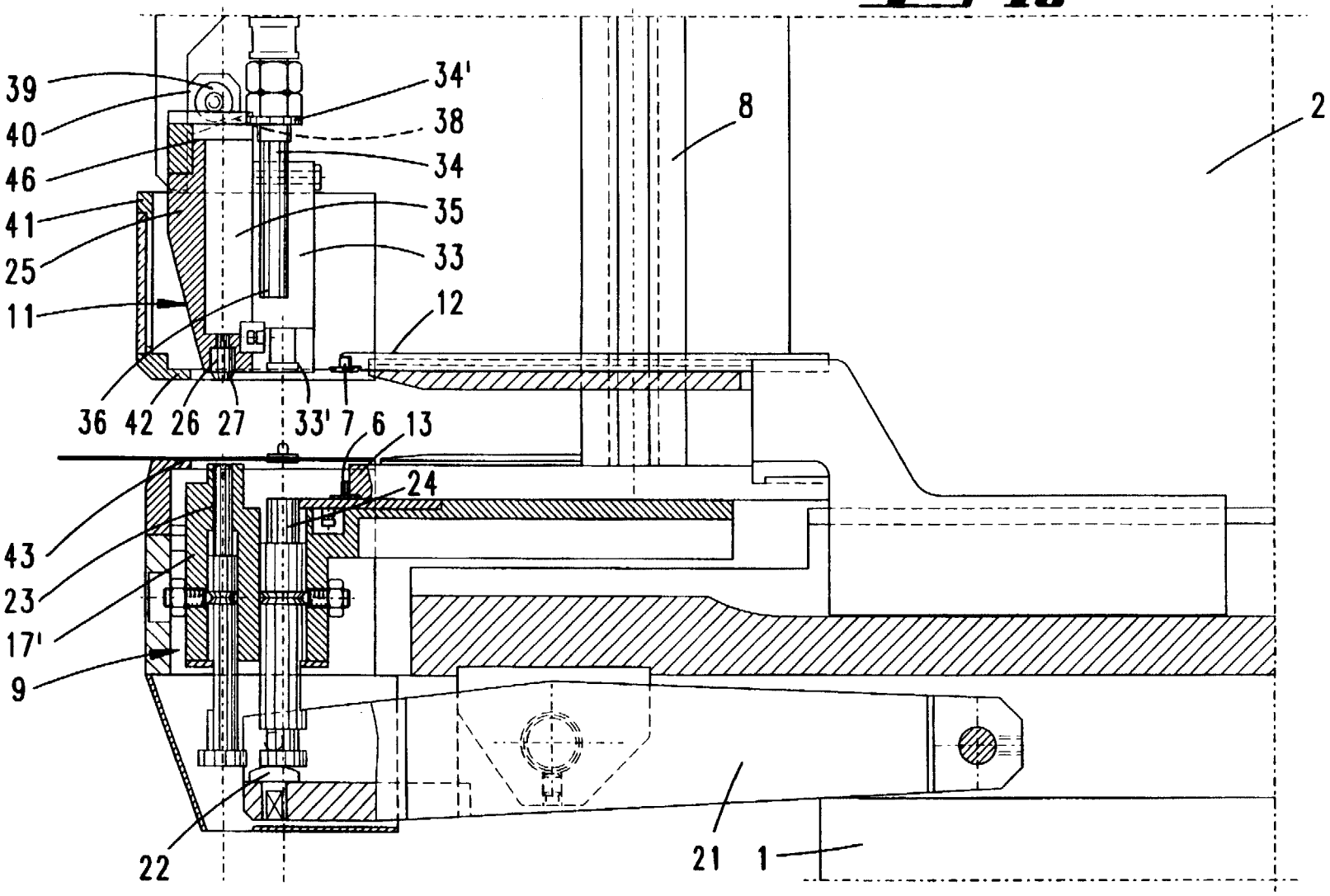
FIG. 12 is the representation following on FIG. 11, after completion of the attachment step as well as the finger protection cage having travelled to its uppermost position, along with the ram being in the return displacement phase of the slide.

FIG. 12 shows the 325° position of the shaft 14. The finger protection cage 41 is again located in its upper position. In addition, the ram 34 has almost arrived at its upper position. The rearwardly directed slide displacement begins. Thus the pressure portion 22 of the force transfer arm is in its lower position, while the pushers 12, 13 push the button portions 6,7. On termination of a 360° rotation of the shaft 14, there is once again the position according to FIG. 3 before completion of a 360° work cycle. The individual positions of the corresponding components are also apparent from the diagram according to FIG. 13. The curve F is traversed by the finger protection cage 41. The ram 34 moves according to the curve S. The slide 17 moves along the curve SK. The curve which is followed by the pressure portion which impacts or engages against the lower tools is indicated by St, while the displacement curve for the pushers 12, 13 carries the reference designation Sch.

We claim:

1. A machine for the attachment of a fastener comprising buttons, rivets and the like, respectively, preferably to articles of clothing, the fastener having an upper portion and a lower portion, the machine comprising an upper clamping jaw and a lower clamping jaw for holding material therebetween, a ram for punching the material by actuation of the ram, a tool slide having an upper tool and a lower tool, and a tool carrier having a control flank; and wherein after movement of the tool slide by actuation of the ram by an approaching of the upper and lower tools towards one another, fastener portions located in the tool slide are in form-locked connection to one another;

upon a horizontal displacement of the tool slide, said control flank of said tool carrier travels underneath a bracket of the upper clamping jaw, said upper clamping jaw forming a finger protection cage enabling vertical downward displacement of the upper tool; and said control flank is inclined to induce a vertical displacement of said upper tool in response to the horizontal displacement of said tool slide.

2. A machine according to claim 1, further comprising a hole punching tool, and an attachment tool disposed at an end of the ram, in a hole punching position, in coaxial disposition with respect to said hole punching tool.

3. A machine according to claim 2, further comprising another punching tool, and a shoulder provided by the ram, wherein said shoulder, during punching of a hole, engages against an opposing shoulder of one punching tool of the two punching tools, which work against one another.

4. A machine according to claim 3, wherein the tool carrier defines both an anvil for punching tools of the machine and also retaining tongs for engagement with a portion of the fastener.

5. A machine according to claim 1, wherein by actuation of the ram, vertical displacement of at least one of said tools occurs.

6. A machine according to claim 1, wherein, upon horizontal displacement of the tool slide, said control flank of said tool carrier travels around the bracket of the upper clamping jaw.

7. A machine according to claim 1, wherein the tool carrier is spring-loaded against the slide in opposition to a direction of operation of the slide.

8. A machine according to claim 1, wherein the upper and the lower tools are displaceable towards one another for a punching operation.

9. A machine according to claim 1, wherein by horizontal displacement of the tool slide, vertical displacement of a least one of said tools occurs.

10. A machine according to claim 1, wherein the upper and the lower tools are displaceable towards one another for an attachment operation.

11. A machine for the attachment of a fastener comprising buttons, rivets and the like, respectively, preferably to articles of clothing, the fastener having an upper portion and a lower portion, the machine comprising an upper clamping jaw and a lower clamping jaw for holding material therebetween, a ram for punching the material by actuation of the ram, a tool slide having an upper tool and a lower tool, and a tool carrier having a control flank; and wherein after movement of the tool slide by actuation of the ram by the upper and lower tools approaching one another, fastener portions located in the tool slide are in form-locked connection to one another;

upon a horizontal displacement of the tool slide, said control flank of said tool carrier travels underneath a bracket of the upper clamping jaw, said upper clamping jaw forming a finger protection cage enabling vertical downward displacement of the upper tool; and wherein the machine further comprises a roller which engages against the control flank of the tool carrier and is associated with the finger protection cage, said roller and said control flank being disengaged in a punching position of the machine.

* * * * *